US006850198B2

(12) United States Patent
Robin

(10) Patent No.: US 6,850,198 B2
(45) Date of Patent: Feb. 1, 2005

(54) ANTENNA DEVICE AND METHOD OF ADJUSTING SAID ANTENNA DEVICE

(75) Inventor: Olivier Robin, Österskär (SE)

(73) Assignee: AMC Centurion AB, Akersberga (SE)

( * ) Notice: Subject to any disclaimer, the term of this patent is extended or adjusted under 35 U.S.C. 154(b) by 0 days.

(21) Appl. No.: 10/415,545

(22) PCT Filed: Dec. 19, 2001

(86) PCT No.: PCT/SE01/02829

§ 371 (c)(1),
(2), (4) Date: Feb. 13, 2004

(87) PCT Pub. No.: WO02/50948

PCT Pub. Date: Jun. 27, 2002

(65) Prior Publication Data

US 2004/0174302 A1 Sep. 9, 2004

(30) Foreign Application Priority Data

Dec. 20, 2000 (SE) ..... 0004723

(51) Int. Cl.[7] ..... H01Q 1/24
(52) U.S. Cl. ..... 343/702
(58) Field of Search ..... 343/702, 725, 343/767, 829, 846

(56) References Cited

U.S. PATENT DOCUMENTS 5,710,987 A * 1/1998 Paulick ..... 455/575.7
5,926,139 A * 7/1999 Korisch ..... 343/702
6,016,126 A * 1/2000 Holshouser ..... 343/702
6,061,024 A * 5/2000 McGirr et al. ..... 343/700 MS
6,140,966 A * 10/2000 Pankinaho ..... 343/700 MS
6,366,243 B1 * 4/2002 Isohatala et al. ..... 343/700 MS

FOREIGN PATENT DOCUMENTS

EP 1 003 240 A2 5/2000
EP 1 067 627 A1 1/2001

OTHER PUBLICATIONS

Zi Dong Liu, Peter S. Hall and David Wake, Dual–Frequency Planar Inverted–F Antenna, Oct. 1997, vol. 45 No. 10, pp 1451–1458.

* cited by examiner

*Primary Examiner*—Tho Phan
(74) *Attorney, Agent, or Firm*—Holland & Hart LLP

(57) ABSTRACT

A dual-band antenna device for a portable radio communication device (2) comprises an inner (10) and an outer (20) generally planar radiating element portion. The inner portion is galvanically ungrounded and connectable to feed and the outer portion is connectable to ground. The element portions are essentially coplanar and separated by a gap (30;30'), wherein the outer element portion (20) surrounds the inner element portion (10). With this configuration desired antenna characteristics are obtainable in a controlled way. A portable radio communication device and a method for separate adjustment of the frequency bands are also provided.

20 Claims, 7 Drawing Sheets

ANTENNA DEVICE AND METHOD OF ADJUSTING SAID ANTENNA DEVICE

FIELD OF INVENTION

The present invention relates generally to antenna devices and more particularly to antenna devices adapted for internal mounting in a portable communication device, such as a mobile phone, wherein the characteristics are adjustable in a controlled way. The invention also relates to a communication device comprising such an antenna device and a method of adjusting the same.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones.

However, the application of internal antennas in a mobile phone puts some constraints on the configuration of the antenna element, such as the dimensions of the element, the exact location of feeding and grounding portions etc. These constraints may make it difficult to find the correct tuning and matching of the antenna. This is especially true for so-called multi-band antennas, such as double-band antennas, wherein the antenna is adapted to operate in two or more spaced apart frequency bands. In a typical dual band phone, the lower frequency band is centered on 900 MHz, the so-called GSM 900 band, whereas the upper frequency band is centered around 1800 or 1900 MHz, the DCS and PCS band, respectively. If the upper frequency band of the antenna device is made wide enough, covering both the 1800 and 1900 MHz bands, a phone operating in three different standard bands is obtained.

The European patent publication EP 1 003 240 A2 discloses a surface mount antenna comprising first and second radiation electrodes separated by a gap. Each electrode is connected to a grounded connection electrode, providing a double resonance with two pass bands. The two pass bands overlap slightly, effectively creating a single-band antenna with one wide pass band instead of a double-band antenna. No guidance of how to obtain desired antenna characteristics is given.

The European patent publication EP 1 067 627 A1 discloses a dual band radio apparatus comprising a first and a second antenna element, both connected to a ground plate. A capacitive coupling is provided between the two antenna elements.

IEEE Transactions on Antennas and Propagation, Vol. 45, No. 10, October 1997, describes in an article by Liu Z D et al. "Dual-Frequency Planar Inverted-F Antenna", pp 1451–1458 a dual-band antenna. An antenna with a single-input port is described on page 1457, where it is indicated that the dual-band antenna can also work with a single feed by electrically shorting the two radiating elements using common short pins.

SUMMARY OF THE INVENTION

An object of the present invention is to provide an antenna device for a portable radio communication device which overcomes the above mentioned problems and wherein desired operating frequency bands can be obtained in a well-defined way.

Another object is to provide a portable radio communication device comprising such an antenna device.

Still another object is to provide a method of adjusting the characteristics of an antenna device in a controlled way.

The invention is based on the realization that an antenna configuration having two element portions spaced apart by a gap can be provided, wherein one element portion is galvanically ungrounded and wherein the length and the width of the gap determines the characteristics of the antenna in a controlled way.

According to the present invention there is provided an antenna device as defined in appended claim 1.

According to the present invention there is also provided a portable radio communication device as defined in appended claim 14.

There is also provided a method of tuning an antenna as defined in appended claim 15.

With the inventive antenna device the above mentioned drawbacks of prior art are eliminated or at least mitigated. The antenna device according to the present invention as defined by the appended claims has a configuration wherein the gap separating the two radiating element portions can be adjusted in a controlled way so as to obtain the desired characteristics.

The dependent claims define further preferred embodiments of the inventive antenna device.

BRIEF DESCRIPTION OF DRAWINGS

The invention is now described, by way of example, with reference to the accompanying drawings, in which:

FIGS. 2*a*–5*a* show the basic antenna pattern with different parameters denoted;

FIGS. 2*b*–5*b* show different antenna patterns derived from the basic antenna pattern shown in the respective FIGS. 2*a*–5*a;*

FIGS. 2*c*–5*c* show frequency diagrams associated with the respective antenna patterns shown in FIGS. 2*a,b*–5*a,b,*

DETAILED DESCRIPTION OF THE INVENTION

In the following, a detailed description of embodiments of a connector device according to the invention will be given. In the description, for purposes of explanation and not limitation, specific details are set forth, such as particular hardware, applications, techniques etc. in order to provide a thorough understanding of the present invention. However, it will be apparent to one skilled in the art that the present invention may be utilized in other embodiments that depart from these specific details. In other instances, detailed descriptions of well-known methods, apparatuses, and circuits are omitted so as not to obscure the description of the present invention with unnecessary details.

Also, when references are made hereinbelow to directions, such as "left" or "right", these references are to be taken in connection with what is shown in the figures as exemplary embodiments and should not be construed as limiting to the scope of protection.

Figure 1:
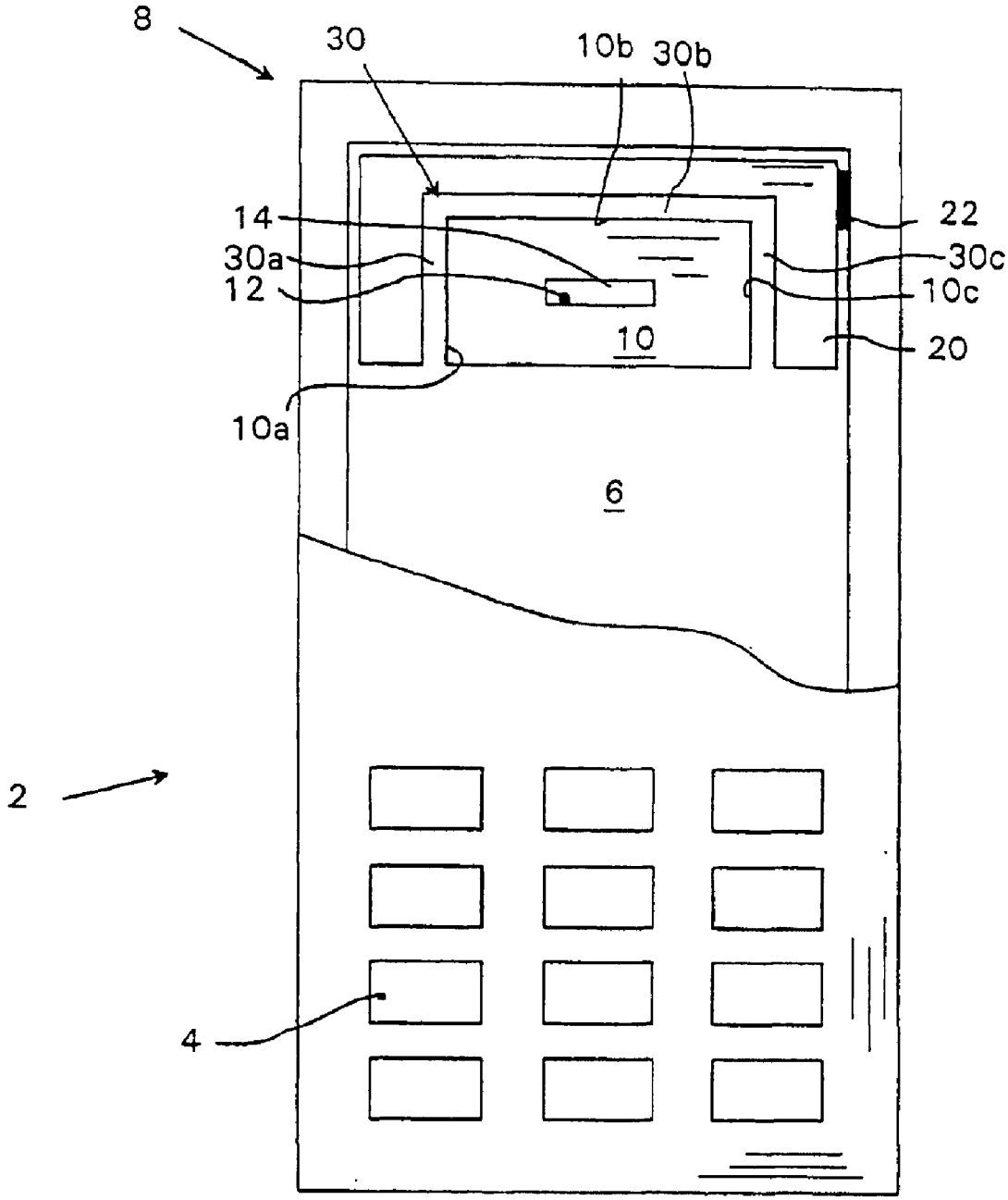
FIG. 1 is an overall view of a mobile phone, partially broken up, showing the positioning of a printed circuit board and a basic antenna pattern according to the invention.

In FIG. 1 there is shown a plan view, partially in cross-section, of a mobile phone, generally designated 2. The mobile phone comprises a keypad 4 etc., as is conventional. Inside the phone 2 there is provided a printed circuit board (PCB) 6 with an extension essentially corresponding to the size of the phone. On the PCB 6 there are mounted electronic circuits etc. (not shown), for the operation of the phone. These circuits will not be discussed further except for the information that they comprise RF circuitry for operation of an antenna, i.e., for transmitting and receiving radio frequency signals.

The PCB 6 also functions as a ground plane for an internal antenna device, in the described embodiment a modified PIFA (PIFA—Planar Inverted F Antenna) generally designated 8 and located in the upper portion of the mobile phone 2. The antenna device comprises a radiating element divided into two generally planar portions, a first inner element 10 and a second outer element 20. The radiating elements 10, 20 are made of some suitable electrically conductive material, such as metal sheet, steel plate or the like, or as a conductive flex film. The elements 10, 20 are supported by a frame made of a non-conductive material, such as a plastic (not shown). By means of the frame, the radiating elements are positioned essentially parallel to the PCB 6 and on a predetermined distance therefrom, which is preferred with this kind of antennas.

The inner radiating element 10 is connected to a contact pin 12 having an extension essentially perpendicular to the plane of the inner element 10 and being electrically connected to the RF circuitry of the underlying PCB 6. The pin 12, being for example of the type sold under the Trademark PoGo, functions as a feeding portion of the antenna. The contact pin 12 is located on the edge of an opening or aperture 14 in the central part of the radiating element portion 10, the function of which aperture will be described below.

The second outer radiating element 20 is connected to a grounding portion 22 extending essentially perpendicularly thereto and being connected to a ground device of the underlying PCB 6. The outer element 20 has a general shape resembling a "C" turned 90 degrees counter-clock-wise, as shown in the figures, thus essentially surrounding the inner element 10.

An important feature is thus that one of the antenna elements is connected to a feed device and the other of the antenna elements is connected to a ground device.

The inner and outer elements 10 and 20, respectively, are essentially coplanar and are separated by a non-conductive interspace or gap 30. As can be seen in the figure, the gap 30 surrounds the inner element 10 on three sides thereof and provides for a controlled capacitive coupling between the inner and outer elements 10, 20. Due to the gap between the inner and outer elements 10, 20 there are two distinct resonance frequencies. By means of this arrangement, a dual-band antenna is created and the capacitive coupling between the radiating elements is used for determining the characteristics of the antenna 8, as will be described in the following and with reference to FIGS. 2*a–c*–5*a–c*.

Figure 2A:
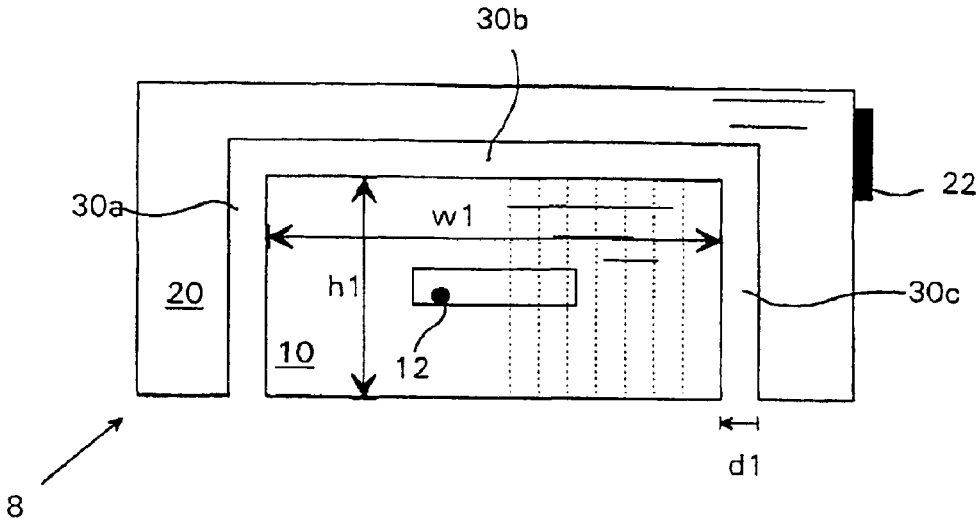
Figure 2B:
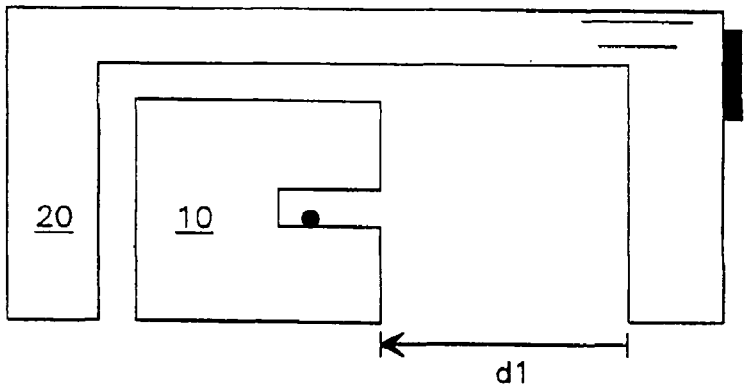
Figure 2C:
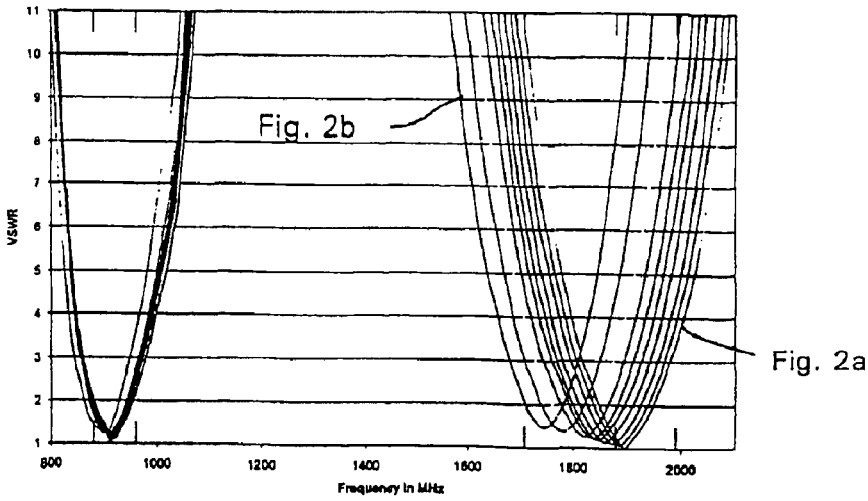

In FIGS. 2*a*, 2*b*, and 2*c* there is shown how the resonance frequency of the upper band of a dual-band antenna can be adjusted in a controlled way. In its basic shape, shown in FIG. 2*a*, the antenna 8 has a lower resonance frequency of about 900 MHz and an upper resonance frequency of about 1900 MHz, thus making it suitable for use in a dual band mobile phone adapted for the GSM 900 and PCS bands.

However, in order to fine-tune the upper band, the shape of the inner radiating element 10 is adjusted in a controlled way. In its basic shape, the inner radiating element 10 is essentially rectangular with a height h1 and a width w1, see FIG. 2*a*. It is surrounded on three sides by the gap 30. In FIG. 2*a*, the gap has been sub-divided into three portions, namely 30*a* to the left of the element portion 10, 30*b* above the element portion 10 and 30*c* to the right of the element portion 10. The three gap portions 30*a–c* have essentially the same width. The inner element 10 is shown with a first end portion 10*a* facing the gap portion 30*a*, a second end portion 10*c* facing the gap portion 30*c* and a portion 10*b* facing the gap portion 30*b*, see FIG. 1.

The antenna characteristics are changed by decreasing the width w1 by increasing the width d1 of the right gap portion 30*c*. More specifically, by increasing the distance d1, the resonance frequency of the upper band is lowered. In FIG. 2*c* there is shown a set of curves representing the Voltage Standing Wave Ratio (VSWR) as a function of frequency. The curves represent the different characteristics when the width w1 of the inner element 10 is adjusted from its original value, FIG. 2*a*, to approximately half its original value, as is shown in FIG. 2*b*.

Referring to FIG. 2*c*, to the left in the diagram there is shown a set of almost identical curves, representing the lower frequency band. Thus, it can be seen that the distance d1 has almost no influence on this band. This is important in that it enables selective adjustment of the upper frequency band.

In contrast to the lower frequency band there is a pronounced correlation between distance d1 and the resonance frequency of the upper band. In the diagram there is shown a set of nine different curves, the rightmost of which representing the VSWR of the starting antenna, i.e., with a small distance d1 (the original antenna shown in FIG. 1), and the leftmost of which representing the VSWR with a large distance d1, as shown in FIG. 2*b*. The intermediate curves represent equally spaced distances d1 between the small and large distances, some of which corresponding to a size of the inner element 10 denoted by dotted lines in FIG. 2*a*.

It is striking how the resonance frequency of the upper band correlates with the value of d1. However, the VSWR for the resonance frequency remains essentially unchanged. It is thus seen that an adjustment of the distance d1 provides for an easy and well-defined way to adjust the characteristics of a dual-band antenna adapted for use with a mobile phone, for example.

Another advantage with an adjustment only relating to the size of the inner element 10 is that the positions of the feeding and grounding portions 12, 22 remain unchanged. From a design and manufacturing point of view this provides a solution wherein the contact points of the underlying PCB 6 remain unchanged, i.e., the same kind of PCB can be used for different phone models, for example dual-band phones for GSM/DCS and GSM/PCS.

Figure 3A:
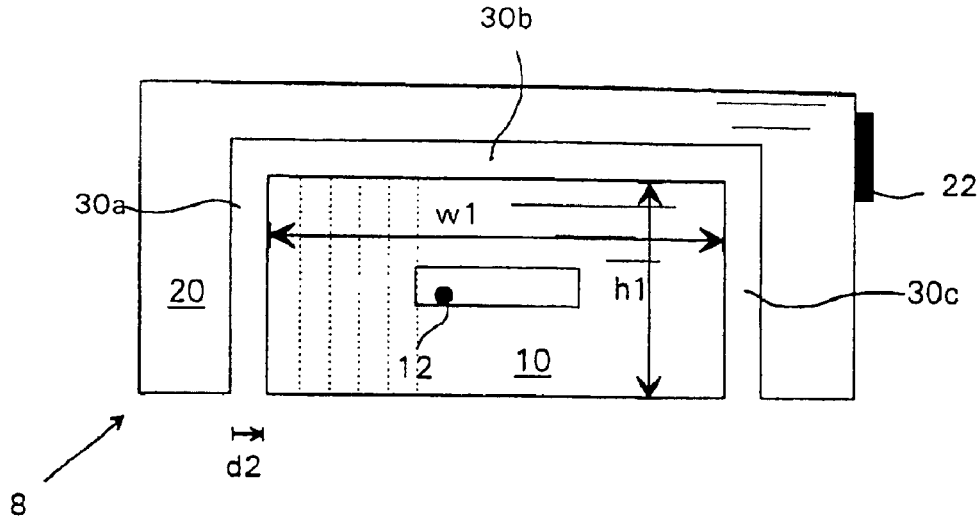
Figure 3B:
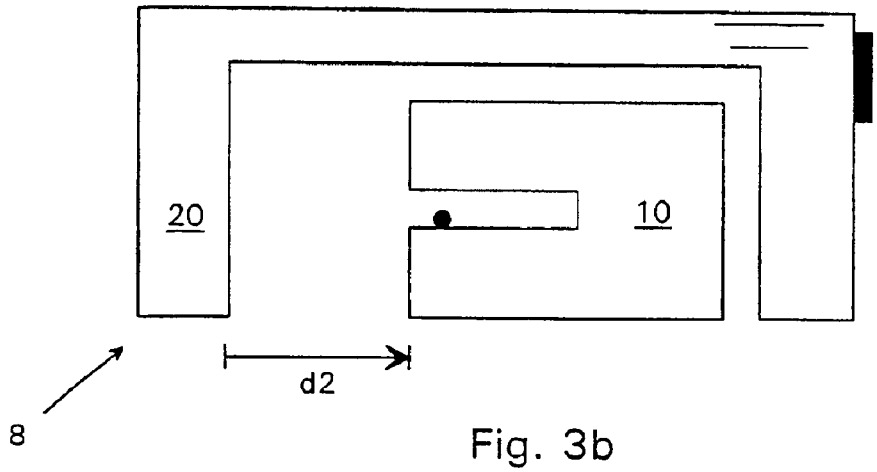

A way to change the resonance frequency of the lower band of the antenna device will now be described with reference to FIGS. 3*a–c*. The procedure is similar to that concerning the upper frequency band, i.e., the size of the inner element 10 is adjusted. However, instead of removing part of the right hand portion of the inner element, i.e., that closer to the grounding portion 22, part of the left-hand portion of the inner element 10 is removed. In other words, the width of the left gap portion 30*a* is changed, this distance being denoted d2 in FIGS. 3*a* and 3*b*.

Figure 3C:
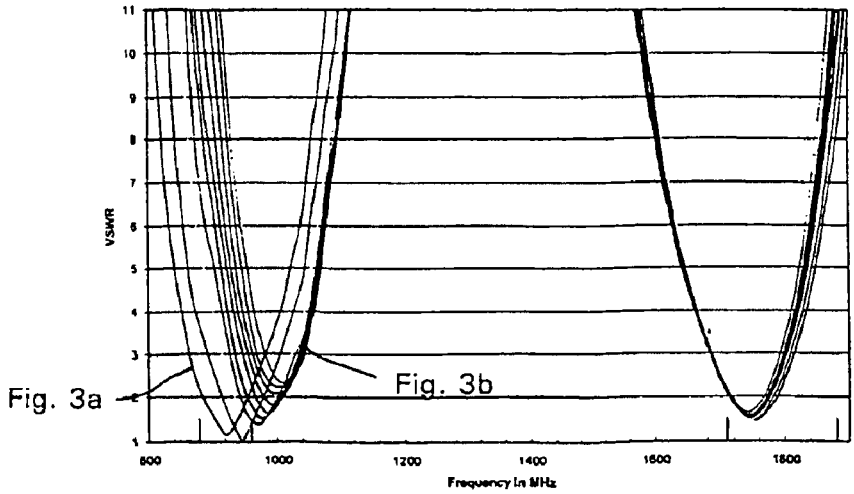

In FIG. 3*c* there are shown two sets of curves for different values of d2, wherein one set relates to the lower band and one set relates to the upper band. The leftmost curve among the lower band curves is associated with the basic antenna pattern shown in FIG. 3*a*, i.e., the small original width d2. The other lower band curves are associated with successively higher values of d2, i.e., there is a direct correlation between the value of d2 and the lower resonance frequency. The rightmost curve of the lower band curves is associated with the antenna pattern shown in FIG. 3*b*, wherein a large portion of the inner radiating element 10 is removed as compared with the basic pattern.

From FIG. 3*c* is also seen that the upper resonance frequency remains virtually unchanged. This means that by changing the value of d2 the lower frequency band can be adjusted without affecting the upper frequency band.

Figure 4A:
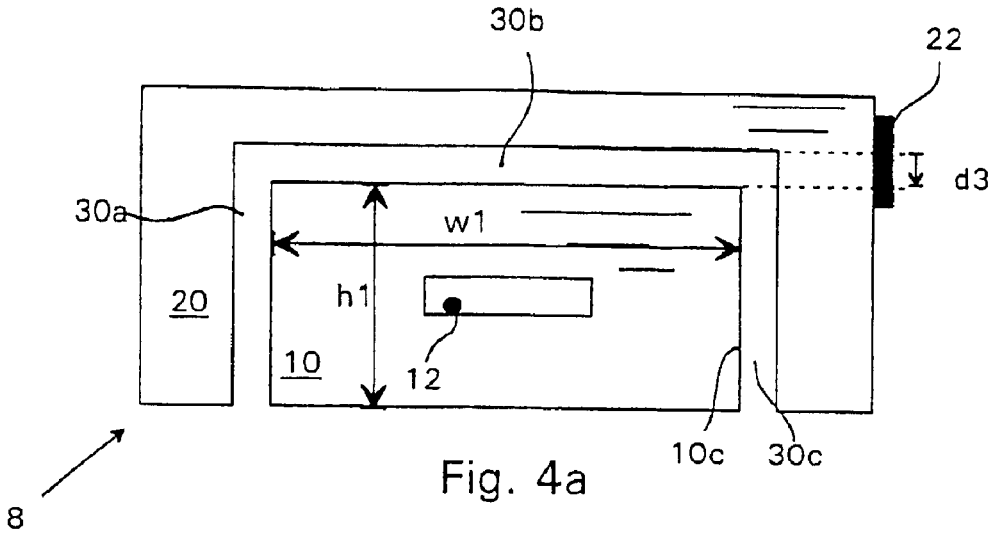
Figure 4B:
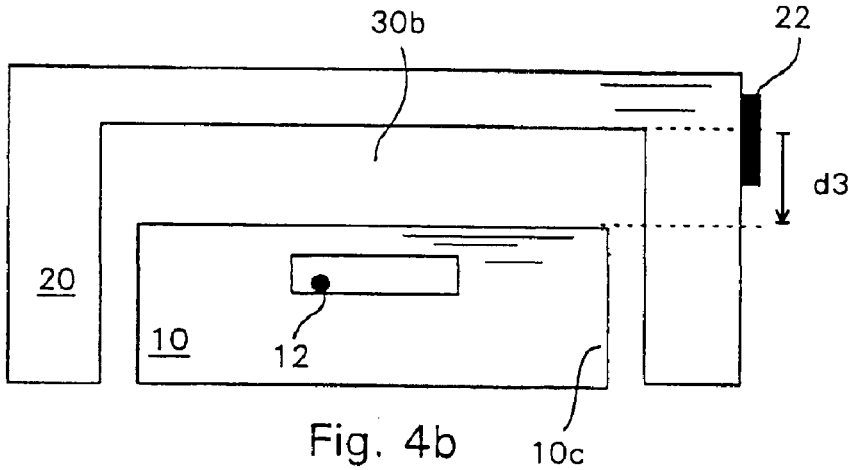
Figure 4C:
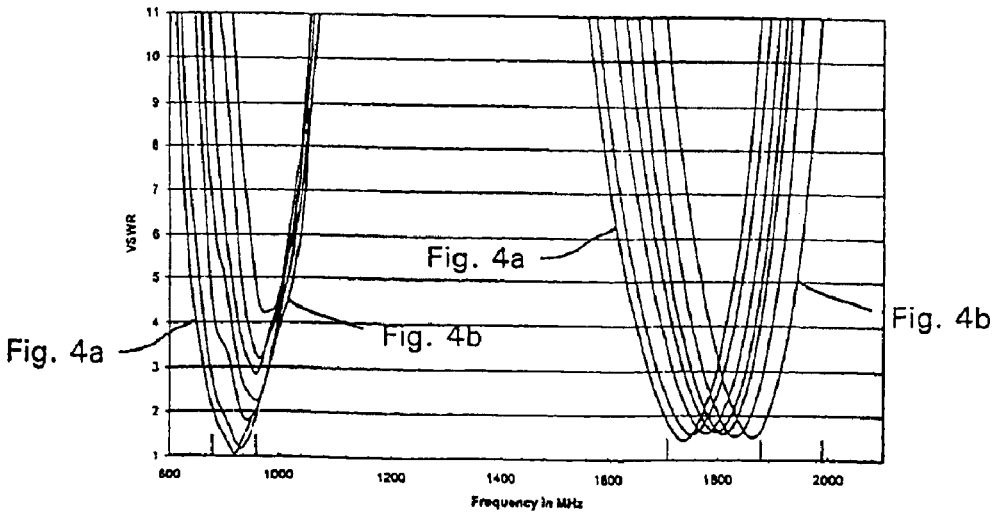

Yet another way of modifying the characteristics of an antenna device in a controlled way will now be explained with reference to FIGS. 4*a–c*. In FIG. 4*a*, there is shown the basic antenna pattern with the effective width of the upper gap portion 30*b* denoted by d3. In FIG. 4*b*, a modified antenna pattern is shown, wherein part of the inner element 10 has been removed as compared with the basic pattern. The amount of inner element material removed corresponds to the increase of the actual distance d3 as compared with FIG. 4*a*.

It is here seen that by changing the distance d3, both resonances are affected and therefore an additional parameter to play with is created in order to match the antenna in a controlled way.

It has been described above how the general shape of the inner and outer radiating elements 10, 20 can be adjusted in order to obtain desired antenna characteristics in a controlled way. Another way to change the characteristics is to change the size of the aperture 14 as will be explained in the following and with reference to FIGS. 5*a–c*.

Figure 5A:
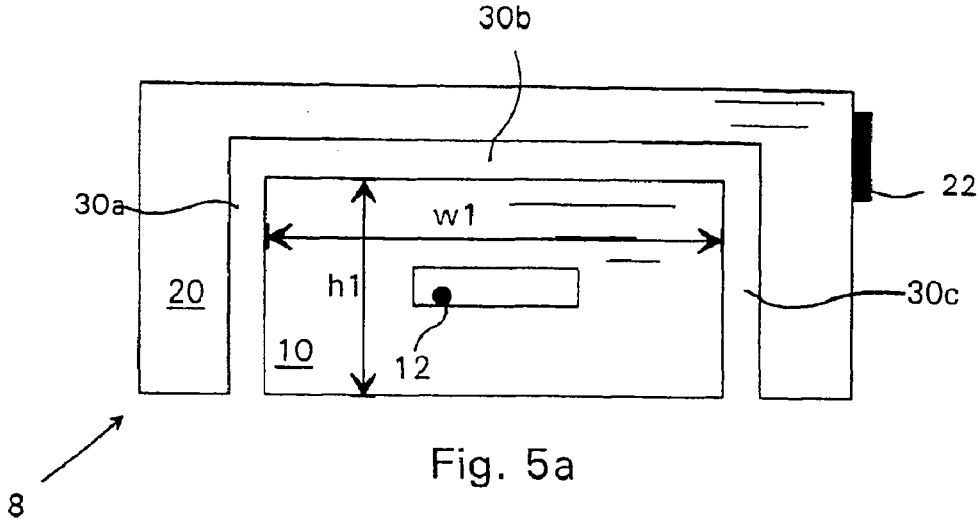
Figure 5B:
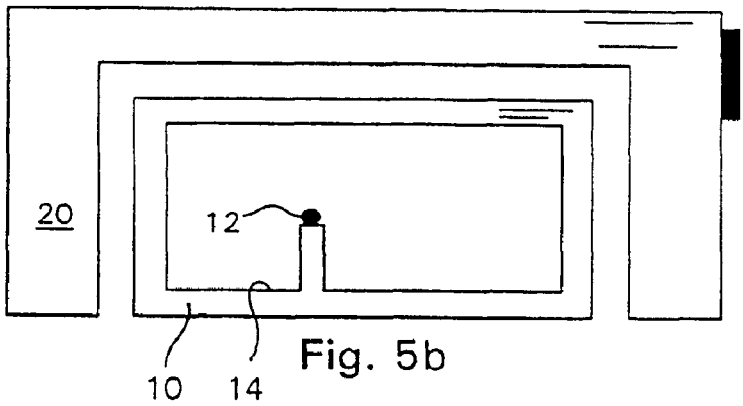
Figure 5C:
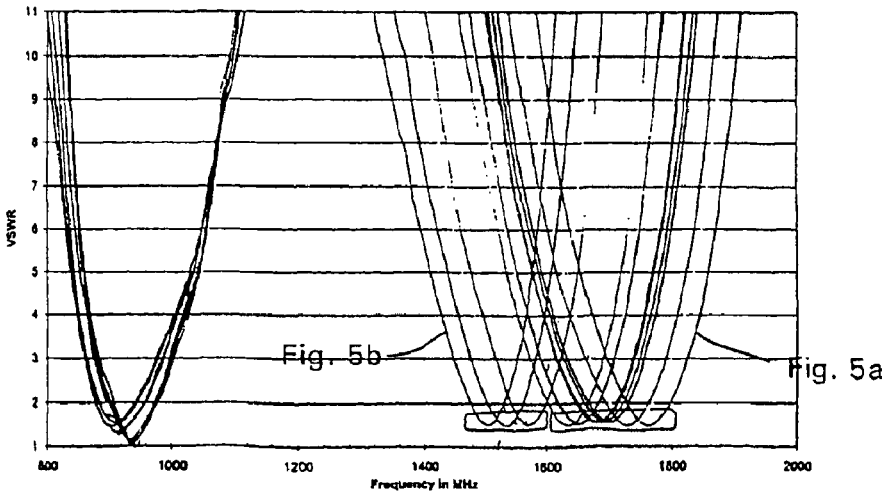

A number of VSWR curves for the upper frequency band is shown in FIG. 5*c*, of which curves the rightmost is associated with the basic antenna pattern as shown in FIG. 5*a*. The leftmost curve of the upper curves is associated with the antenna pattern shown in FIG. 5*b*, wherein the aperture 14 has been enlarged as compared to that of the basic pattern. The intermediate curves falling between these two extreme cases represent the VSWR of apertures 14 having a size between those shown in FIGS. 5*a* and 5*b*. Thus, by changing the size of the aperture 14, the upper resonance frequency can be changed in a controlled way. As in the embodiment described with reference to FIGS. 2*a–c*, the lower resonance frequency determining the lower frequency band remains virtually unchanged, thereby allowing for a selective adjustment of the upper frequency band.

Figure 6:
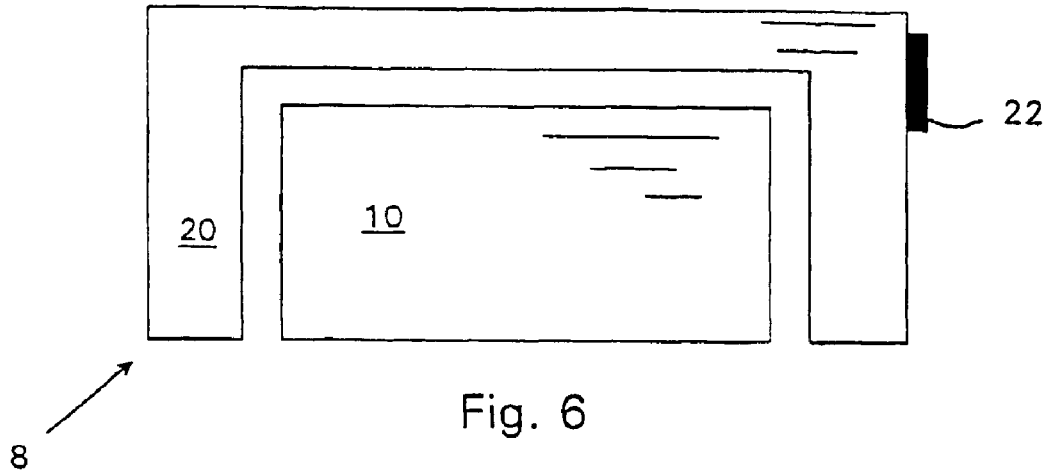
FIG. 6 shows an alternative basic antenna pattern.

Besides providing for an adjustment of the upper frequency band, the change of size of the aperture 14 can be used for impedance matching the antenna device or to enable the use in this area of an external connector or other element, such as a plastic part extending from the housing of the device in which the antenna is provided. In FIG. 6 there is shown a plan view of an alternative antenna pattern wherein the aperture in the inner element 10 has been omitted. Thus, the contact pin 12, shown in phantom in the figure, is attached to the underside of the element 10 by means of riveting or the like.

Figure 7:
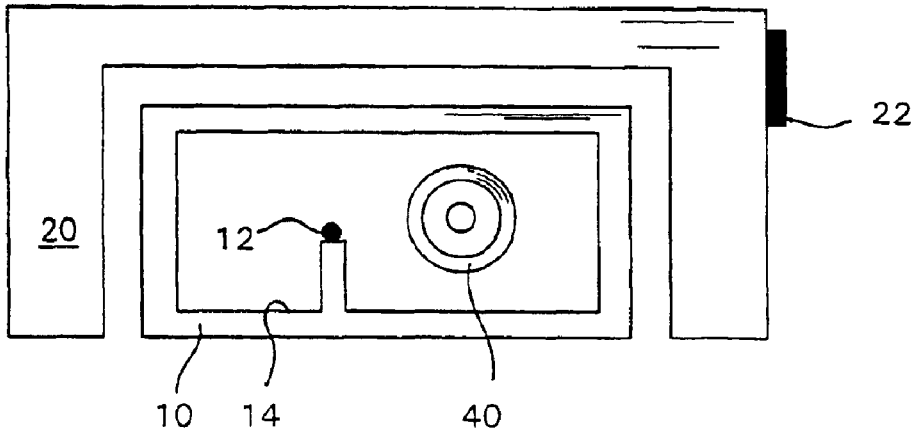
FIG. 7 shows an antenna pattern adapted for use with an external connector.

In FIG. 7 there is shown an antenna pattern similar to that shown in FIG. 5*b*. In addition to the antenna elements 10, 20 there is shown a coaxial connector, generally designated 40, connected to the underlying PCB 6. The connector 40 is provided for connection of an external antenna device, such as an antenna provided on the outside of a car in which a mobile phone is operated by means of a so-called hands-free equipment. Thus the aperture 14 provides for a compact solution for positioning an external connector, a typical size of which is a diameter of six millimeters.

Figure 8:
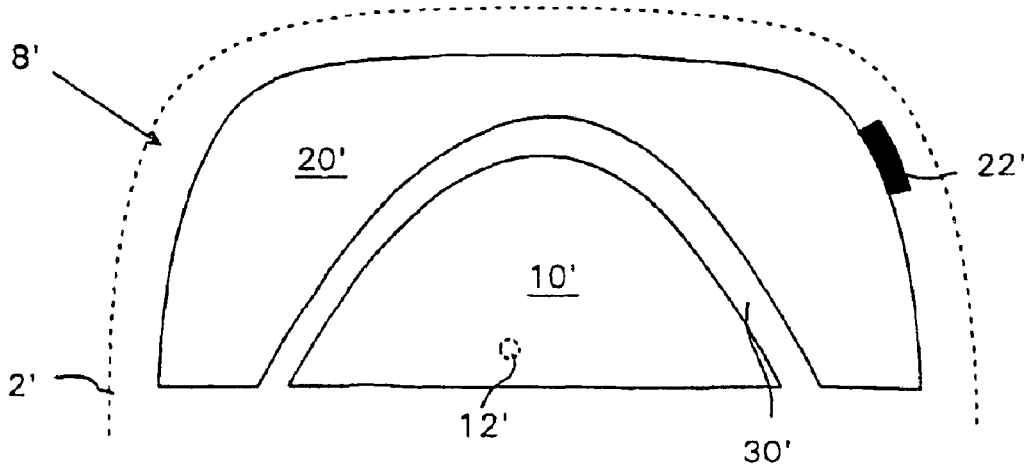
FIG. 8 shows an antenna device with yet an alternative shape.

In the embodiments described with reference to FIGS. 1–7, the inner element 10 has been shown with a rectangular shape. However, many other shapes are viable, such as the one used in the antenna device 8' shown in FIG. 8, wherein the inner rectangular element 10 of the previous embodiments has been replaced with an inner element 10' with a lower straight edge and an upper curved edge. An essentially uniform gap 30' separates the inner element 10' from an outer element, denoted 20', having an outer shape adapted to a mobile phone in which it is mounted. The contour of the upper portion of the mobile phone 2' is denoted by a dotted line in FIG. 8. As in the previous embodiments, the inner element 10' comprises a feeding portion 12' and the outer element 20' comprises a grounding portion 22'.

Figure 9:
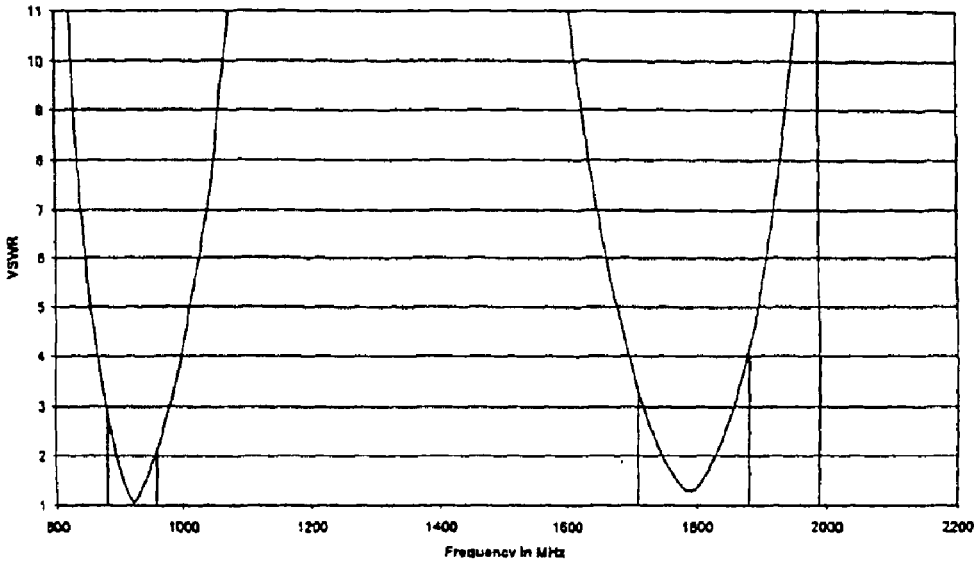
FIGS. 9 and 10 show frequency diagrams of an antenna device adapted to operation in desired frequency bands.
Figure 10:
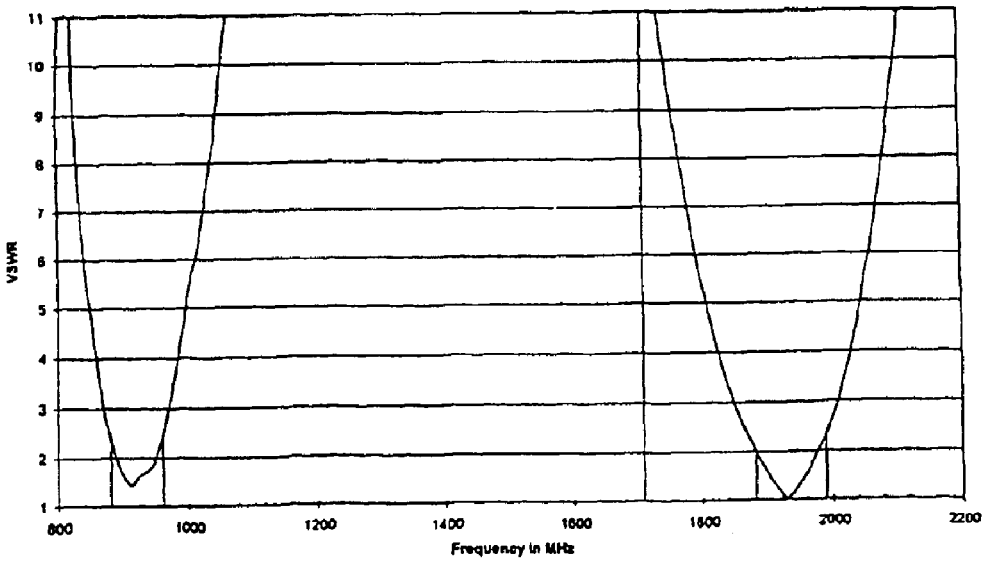

Finally, in FIGS. 9 and 10, there are shown curve diagrams showing the characteristics for the antenna device according to the invention adapted for dual-band operation in the 900/1800 MHz bands and the 900/1900 MHz bands, respectively. It is here seen, that desired characteristics can be achieved in a controlled way with the inventive device.

Preferred embodiments of an antenna device according to the invention have been described. The person skilled in the art realizes that these could be varied within the scope of the appended claims. Thus, the shapes of the different parts shown in the figures can of course be adapted to different needs.

Similar shapes and dimensions for the basic antenna pattern have been shown in the figures. It will be appreciated that these can be varied as long as the general shape with an inner radiating element with a feeding portion is surrounded by an outer radiating element with a grounding portion. Thus, the effective length and width of the left and right gap portions 30*a*, 30*c* can be adjusted by removing part of the outer element facing the gap portion in question, thereby adjusting the resonance frequencies of the device.

The grounding portion 22 has been shown with a constant size throughout the figures. However, the size of the grounding portion can be used as a parameter when adjusting the characteristics of the antenna device.

Also the positioning of the feeding and grounding portions 12, 22 are the same in all figures. However, the distance between the feeding and grounding portions can be used as a means for adjusting the resonance frequencies of the antenna device. Also, the provision of the grounding portion 22 to the right of the inner portion 10 can of course be replaced by it being positioned to the left of the inner portion 10. In that case, the reference in this description to "left" and "right" should be exchanged for each other.

Different ways of adjusting the upper and lower frequency bands of a dual-band antenna have been explained. Although the different ways have been described separately, it will be appreciated that more than one can be applied simultaneously. Although the inner and outer elements 10, 20 have been described and shown as generally planar, it will be appreciated that they can deviate from the planar shape so as to be adapted to the outer shape of the mobile phone in which they are provided, for example.

Throughout this description, the term radiating element has been used. It is to be understood that this term covers any antenna element adapted to receive or transmit electromagnetic waves.

When in this description there is referred to the width of the gap 30, this refers to the distance between the inner and outer elements 10 and 20 in the gap portion in question. Also, when the length of a gap portion is discussed, reference is made to the effective length of the edge portion of the inner element 10 facing the gap portion in question.

What is claimed is:

1. An antenna device for a portable radio communication device operable in at least an upper and a lower frequency band, said antenna device comprising:

a first generally planar radiating element portion having a feeding portion connectable to a feed device of said radio communication device, wherein said first radiating element portion is galvanically ungrounded a second generally planar radiating element portion having a grounding portion connectable to a ground device of said radio communication device, wherein said first and second antenna element portions are essentially coplanar and separated by a gap, and wherein said second radiating element portion surrounds said first radiating element portion.

2. The antenna device according to claim 1, wherein said second radiating element portion is essentiaily C-shaped.

3. The antenna device according to claim 1, wherein said grounding portion is located on an outer edge of said second radiating element portion.

4. The antenna device according to claim 1, wherein said grounding portion is located on an end portion of said second radiating element portion.

5. The antenna device according to claim 1, wherein said first radiating element portion is essentially rectangular.

6. The antenna device according to claim 1, wherein said first radiating element portion has a first, a second, and a third edge portion, said third edge portion is located closer to said grounding portion than said first edge portion and said second edge portion is located between said first and second edge portions, and said first edge portion faces a first gap portion, said second edge portion faces a second gap portion, and said third edge portion faces a third gap portion of said gap.

7. The antenna device according to claim 6, wherein said gap portions are of essentially equal width.

8. The antenna device according to claim 6, wherein said first gap portion has a width exceeding the width of said second and third gap portions.

9. The antenna device according to claim 6, wherein said third gap portion has a width exceeding the width of said first and second gap portions.

10. The antenna device according to claim 6, wherein said second gap portion has a width exceeding the width of said first and third gap portions.

11. The antenna device according to claim 1, wherein said first radiating element portion comprises an aperture.

12. The antenna device according to claim 11, wherein said feeding portion is located on an edge of said aperture.

13. The antenna device according to claim 11, wherein said aperture is adapted to receive an external connector.

14. The antenna device according to claim 1, wherein said first radiating element portion has a first, generally straight side and a second curved side facing said gap.

15. A portable radio communication device operable in at least an upper and a lower frequency band and having a key pad and a printed circuit board with a ground device and RF circuitry forming a feed device, said communication device further having an antenna device comprising:

a first generally planar radiating element portion having a feeding portion connected to the feed device, wherein said first radiating element portion is galvanically ungrounded a second generally planar radiating element portion having a grounding portion connected to the ground device, wherein said first and second antenna element portions are essentially coplanar and separated by a gap, and wherein said second radiating element portion surrounds said first radiating element portion.

16. A method for adjusting a resonance frequency of for a portable radio communication device operable in at least an upper and a lower frequency band and having an antenna device comprising:

a first generally planar radiating element portion having a feeding portion connectable to a feed device of said radio communication device, wherein said first radiating element portion is galvanically ungrounded a second generally planar radiating element portion having a grounding portion connectable to a ground device of said radio communication device, wherein said first and second antenna element portion are essentially coplanar and separated by a gap, and wherein said second radiating element portion surrounds said first radiating element portion wherein said method comprises the step of adjusting any of the length and the width of said gap.

17. The method according to claim 16, wherein said first radiating element portion has a first, a second, and a third edge portion, said third edge portion is located closer to said grounding portion than said first edge portion and said second edge portion is located between said first and second edge portions, and said first edge portion faces a first gap portion, said second edge portion faces a second gap portion, and said third edge portion faces a third gap portion of said gap, wherein said method comprises the step of adjusting the width of said first gap portion, such as to adjust said lower frequency band.

18. The method according to claim 16, wherein said first radiating element portion has a first, a second, and a third edge portion, said third edge portion is located closer to said grounding portion than said first edge portion and said second edge portion is located between said first and second edge portions, and said first edge portion faces a first gap portion, said second edge portion faces a second gap portion, and said third edge portion faces a third gap portion of said gap, wherein said method comprises the step of adjusting the width of said third gap portion, such as to adjust said upper frequency band.

19. The method according to claim 16, wherein said first radiating element portion has a first, a second, and a third edge portion, said third edge portion is located closer to said grounding portion than said first edge portion and said second edge portion is located between said first and second edge portions, and said first edge portion faces a first gap portion, said second edge portion faces a second gap portion, and said third edge portion faces a third gap portion of said gap.

20. The method according to claim 16, wherein said first radiating element portion has a first, a second, and a third edge portion, and an aperture, said third edge portion is located closer to said grounding portion than said first edge portion and said second edge portion is located between said first and second edge portions, and said first edge portion faces a first gap portion, said second edge portion faces a second gap portion, and said third edge portion faces a third gap portion of said gap, wherein said method comprises the step of adjusting the size of said aperture, such as to adjust the lower frequency band and/or to match said antenna device.

* * * * *